United States Patent [19]

Lindenman

[11] 3,956,687

[45] May 11, 1976

[54] STAGGERED STAGE SHUNT REGULATOR

[75] Inventor: Gerald A. Lindenman, Torrance, Calif.

[73] Assignee: Hughes Aircraft Company, Culver City, Calif.

[22] Filed: Dec. 27, 1973

[21] Appl. No.: 432,261

[52] U.S. Cl. ..... 323/8; 323/15; 323/22 Z; 323/23

[51] Int. Cl.[2] ..... G05F 1/60

[58] Field of Search ..... 307/52, 53, 54, 60, 307/61, 64, 66, 130, 297; 323/1, 8, 15, 19, 23 Z, 23, 25

[56] References Cited

UNITED STATES PATENTS

| | | | |
|---|---|---|---|
| 3,480,789 | 11/1969 | Binckley et al. | 307/53 |
| 3,487,229 | 12/1969 | Krausz | 307/130 X |
| 3,600,599 | 8/1971 | Wright et al. | 307/53 |
| 3,696,286 | 10/1972 | Ule | 323/15 |

OTHER PUBLICATIONS

Nekrasov, Shunt Type Voltage Regulator, RCA Technical Note 783, Sept. 1968, 4 pp.

*Primary Examiner*—A. D. Pellinen
*Attorney, Agent, or Firm*—Fay I. Konzem; W. H. MacAllister

[57] ABSTRACT

A regulator which shunts excess current from a solar cell array in which zener diodes of different values are used to separate the control signal into divisions. The control signal, now divided, is used to separate array current into divisions. Each of the divisions of current is shunted by a separate power transistor stage, which is active only over a limited portion of the entire current range. The advantage of having each of the power stages active only over a particular range is to reduce the power dissipation in the shunt regulator by a significant amount and thereby allow greater mechanical design flexibility and lower overall weight.

7 Claims, 3 Drawing Figures

STAGGERED STAGE SHUNT REGULATOR

The invention herein described was made in the course of or under a Contract or Subcontract thereunder with the Department of the Air Force.

BACKGROUND OF THE INVENTION

1. Field of the Invention

This invention relates to shunt regulators and, more particularly, to a shunt regulator having staggered or offset power stages over the range of current delivered by the solar cell array.

2. Description of the Prior Art

In the art shunt regulators have been used to maintain a constant output voltage by controlling the current through a power resistor in series with the load. Prior art shunt regulators used in conjunction with solar cell arrays use the total current from the solar array and feed it into power stages. These regulators operate the power stages in parallel, attempting to cause each power device to instantaneously share the total current equally. A major drawback with this type of shunt regulator with a single tap from the solar array is that in high power systems, high power dissipation occurs due to the high current levels required to be carried by the regulator. In some systems, though, such as spacecraft, it is necessary to reduce the power dissipation in order to allow for less overall size and weight and greater reliability.

SUMMARY OF THE INVENTION

The staggered stage shunt regulator in accordance with the invention comprises a plurality of power stages and switching means. Activating the switches in sequence sequentially shunts excess current to maintain a predetermined output voltage from a solar cell array. Shortly before one power stage is saturated, the next stage is activated until all of the power stages have been activated and then saturated in sequence. By using the staggered stages to regulate the output voltage from the solar cell array, the power dissipation is substantially decreased allowing greater mechanical design flexibility.

Accordingly, it is an object of this invention to provide a staggered stage shunt regulator maintaining a specific voltage within a definite voltage range which minimizes power dissipation.

It is another object to provide an error amplifier and predriver or error amplifier alone for controlling the elements of regulation of the output voltage from the solar cell array.

It is a further object to provide a plurality of different valued zener diodes which divide the control signals into different parts.

It is still a further object of the invention to provide a plurality of drivers which produce base drives for the power stages which regulate the solar cell array's voltage.

It is a further object to provide a plurality of power stages to shunt excess current from the solar cell array.

The features of the present invention which are believed to be novel are set forth with particularity in the appended claims. The present invention, both as to its organization and manner of operation together with further objects and advantages thereof, may be understood best by reference to the following description, taken in connection with the accompanying drawings.

A BRIEF DESCRIPTION OF THE DRAWINGS

DETAILED DESCRIPTION

Figure 1:
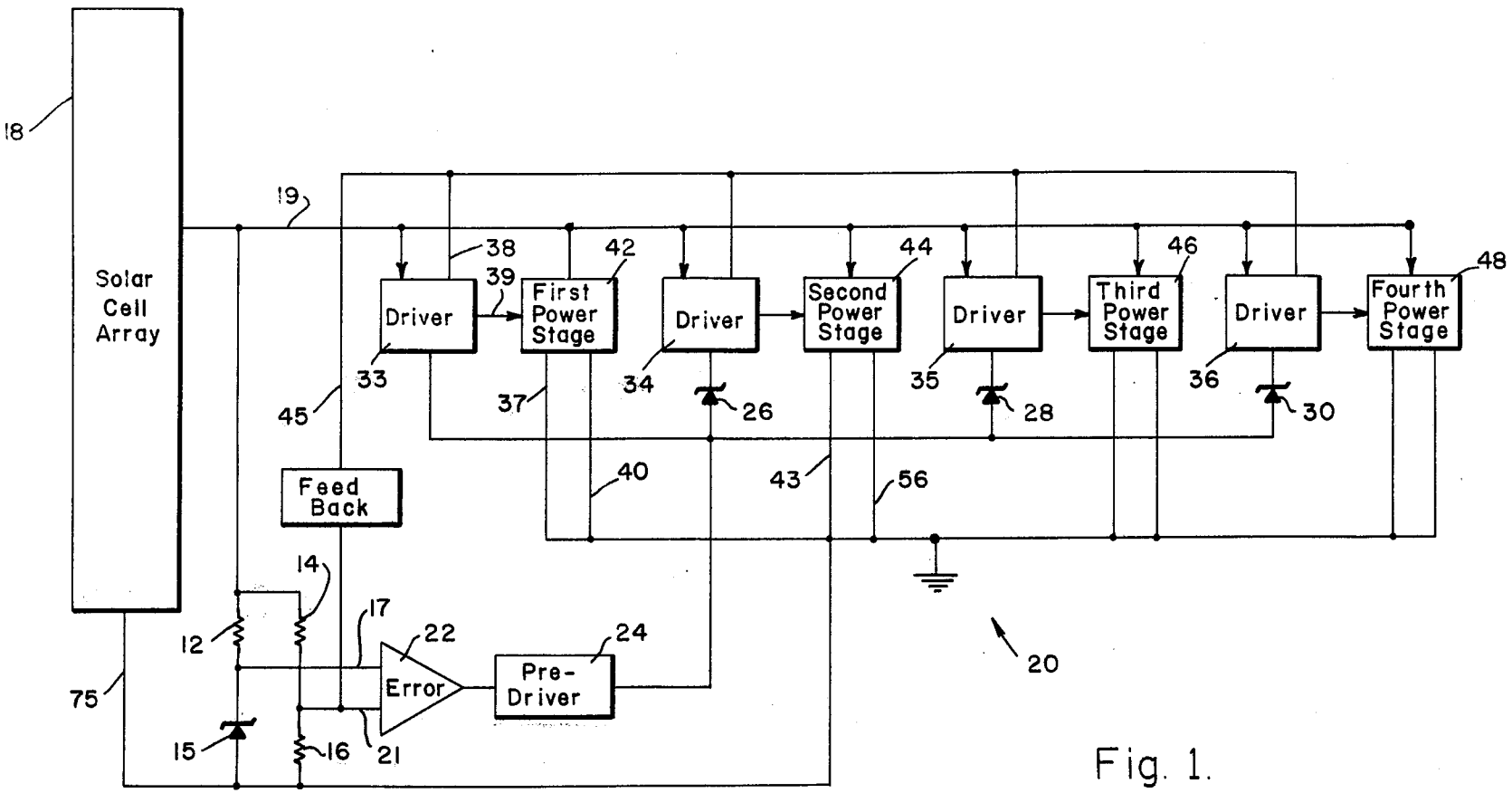
FIG. 1 is a block diagram of the staggered stage shunt regulator for a solar cell array. The regulator consists of an error amplifier, predriver, different valued zeners, drivers, and power stages in accordance with the invention.

Referring now to FIG. 1, a main solar cell array 18, which has many standard solar cells to produce voltage, is regulated by means of a staggered stage shunt regulator 20. One voltage input 17 to the error amplifier is provided by the reference voltage from resistor 12 and zener diode 15, which are connected in series. Then the second input 21 to the error amplifier is provided by means of the voltage divider network comprising resistors 14 and 16, to make this voltage approximately equal to the reference voltage, when the array output is within the regulation.

Any deviation from the 32.50±0.50 volts dc (or whatever voltage is needed) required to be delivered from the solar cell array is therefore amplified by the error amplifier 22 and appears in amplified form as the voltage at the output of the error amplifier. This voltage causes more current to flow through predriver 24, thereby turning it on harder and harder as more current is needed to regulate the output voltage from the solar cell array. Predriver 24 then causes current to be conducted in driver 33. Another input, via line 19, is provided to driver 33 by the bus voltage from the solar array. Output 38 from the driver 33 feeds back, via line 45, to the error amplifier 22 to establish a more stable reference level for the error amplifier. Output 39, from the driver 33 provides base drive current for the activating of the first power stage 42, and causing the array current to be drawn through the first power stage. This current is returned to the solar array by means of lines 37 and 40. Power input 19 from the solar array 18 provides power to the first power stage 42. When the voltage output from the predriver 24 rises above a first preselected level, which is the voltage at which the first power stage becomes saturated, the current breaks over the junction of the first zener diode 26 and causes it to conduct, which in turn causes the second driver 34 to conduct. One output from driver 34 feeds back, via line 45, to the error amplifier. The other output from driver 34 will be positive current which will cause the second power stage 44 to conduct. Power stage 44 also inputs power via power input from the solar array and shunts excess current, via lines 43 and 56 to the return of the solar array.

When the voltage output from the predriver 24 rises above a second preselected level, which is the voltage at which the second power stage becomes saturated, the current breaks over the junction of the second zener diode 28 (FIG. 1) and causes it to conduct, which in turn causes the third driver 35 to conduct, which causes the third power stage 46 to conduct and to shunt the excess current to the return of the solar array. This process of one power stage shunting current until the stage goes to saturation and then another stage shunting until it becomes saturated continues until the last power stage is saturated, at which point the maximum possible current that the regulator may shunt is being returned to the solar cell array. Any number of power stages, along with the zener diodes, and drivers may be chosen depending on a trade-off of power dissipation versus part cost and quantities.

Figure 2:
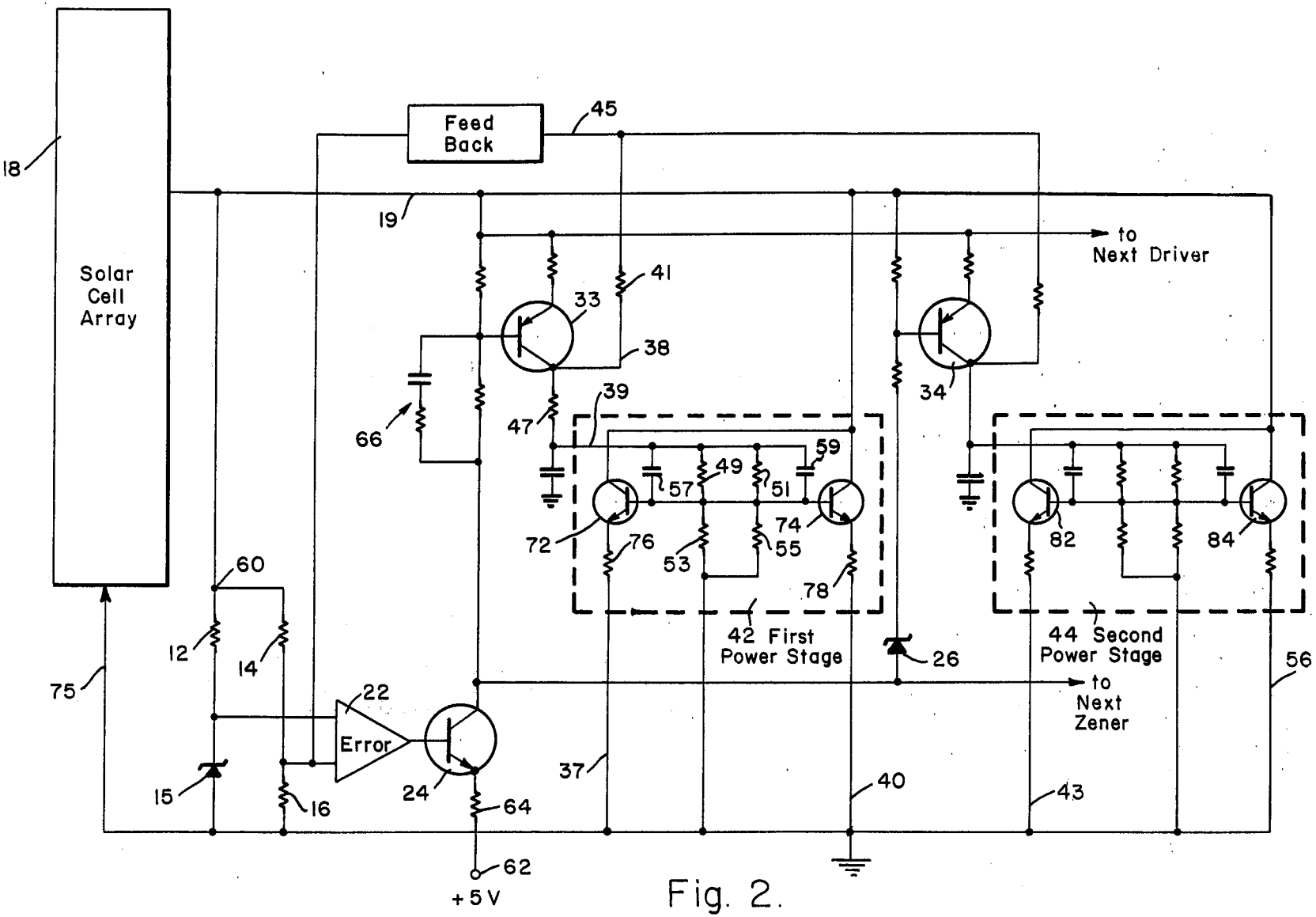
FIG. 2 is a schematic drawing of two of the stages of the staggered stage shunt regulator.

FIG. 2 exhibits a practical schematic embodiment of the block diagram of FIG. 1 of the shunt regulation circuitry which consists of an error amplifier, predriver, driver, and a plurality of power stages. Point 60 senses the amount of voltage being delivered from the solar cell arrays 18; and if there is a deviation from the 32.50±0.50 volts dc regulation, the error amplifier, which is a standard operational amplifier, causes more current to flow to the NPN transistor predriver 24. The three resistors 12, 14, and 16 in conjunction with the zener diode 15 provide the correct biasing and an accurate reference level for the error amplifier 22. The base of the predriver 24 is connected to the error amplifier 22. The emitter is connected to a 5 volt dc power supply 62 through a limiting resistor 64 (a connection to return would also be effective), and the collector of predriver transistor 24 is connected to the base of a PNP transistor driver 33 through a resistance-capacitance network 66. The RC network 66 is used to help control the response time of the regulator so that stability can be achieved. The collector of the NPN predriver 24 is also connected to the anode of the first zener diode 26. As more current is delivered to predriver 24, the collector output voltage of predriver 24 gets less positive, for the collector voltage is closer to the +5 volts dc emitter voltage (or return). The voltage drop across the collector to emitter junction of predriver 24 approaches zero, in an approximately linear manner. This lower output from the collector of the predriver 24 pulls down the base junction of the PNP driver transistor 33 and thereby causes more current to conduct from the emitter to the collector of driver 33. The base of driver 33 is also connected to the bus voltage from the solar cell array, via line 19. The base of driver 33 could also be connected to one of the power input lines or to a separate power supply. The collector of driver 33 is connected to a summing resistor 41 which feeds back, via line 45, more current to error amplifier 22 to establish an additional feedback signal for the error amplifier. The collector of driver 33 is also connected to the bases of NPN power transistors 72 and 74, through the resistors 47, 49, and 51, and capacitors 57 and 59. Resistors 53 and 55 maintain transistors 72 and 74 OFF when driver 33 is OFF. These resistors limit the driver current from driver 33 to transistors 72 and 74, and the capacitors provide noise suppression and eliminate spikes. Power input from the solar array delivers power to the collectors of transistors 72 and 74. As more current conducts in driver 33, its collector starts going more positive and increases the voltage on the base junctions of the first and second transistors 72 and 74, respectively, causing them to conduct. The bases and collectors of transistors 72 and 74 are connected to each other, putting them in parallel operation. The separate resistors 76 and 78 are used to force current sharing between the two power stage transistors 72 and 74. Transistors 72 and 74 continue conducting until they go to saturation.

Zener diode 26 maintains a constant voltage between its anode and its cathode when biased properly. So when the output from the collector of the predriver 24 decreases, the anode voltage of zener diode 26 decreases until its breakdown voltage is reached and the zener 26 begins to conduct. So when the output voltage from the collector of the predriver 24 decreases, the cathode voltage of zener diode 26 decreases. When the cathode of zener 26, which is connected to the base of PNP transistor driver 34, starts pulling the base of driver 34 lower, the zener causes the driver 34 to conduct. As in the previous power stage 42, when the driver 34 starts to conduct, the collector becomes more positive which pulls the bases of transistors 82 and 84 higher causing them to conduct. This process continues along down the line until the last power stage is reached.

Figure 3:
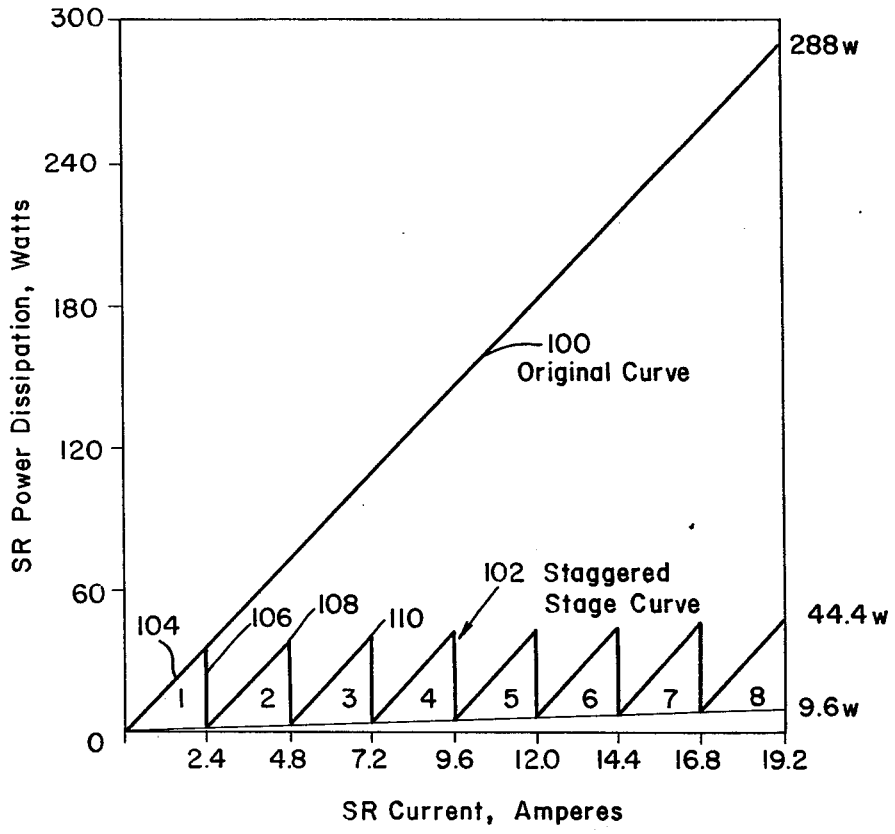
FIG. 3 is a graph comparing the power dissipation of a prior art shunt regulator with the staggered stage regulator of this invention.

FIG. 3 shows the power dissipation curves for a single tap shunt regulator compared with staggered stage regulator of the invention. Along the y-axis is plotted the power dissipation of the transistors in the power stages of the regulator in watts and along the x-axis is plotted the shunt regulator current in amperes. In the prior art single stage shunt regulator, the power dissipation versus current plot would look like curve 100; as the voltage increased, the current would increase (linearly) to a maximum value. Curve 102 shows the power dissipation versus current for the staggered stage shunt regulator of the invention.

Power dissipation = (voltage drop x current). When the two transistors in each of the power stages saturate, the voltage drop in the transistors approaches zero. (The voltage drop does not go all the way to zero because the transistor is an active device.) Therefore, as the voltage drop across the transistor approaches zero, the power dissipation also approaches zero and limits at about 1.2 watts, after the transistor saturates. Referring to FIG. 3, line 104 represents the time when the first power stage is conducting; and, therefore, the current is increasing in a linear manner. Line 106 represents the condition whereby the transistors of the first power stage are becoming saturated, thereby decreasing the power dissipation to zero or near zero. This process is continued by the second power stage as represented by curve 108 and by the third power stage as represented by curve 110 along down the line. The advantage of the staggered stage shunt regulator of the invention is that much of the time the shunt regulator is operating, the power dissipation is decreasing and going to near zero (as illustrated by line 106). This significant reduction in power dissipation allows greater design flexibility and lower overall weight of the shunt regulator system.

Solar cell array 18 comprises a plurality of photoelectric devices arranged in series and parallel combinations so that, when the array is in optimum sunlight, it provides a certain maximum voltage and current (power). Certain effects reduce the output voltage. One of these effects is the destruction of some of the cells through micrometeorite impact. Another factor is the load, and another the solar influx angle. Thus, the solar cell array 18 is designed to provide an optimum maximum voltage between positive and negative buses 19 and 75 greater than the minimum tolerable value. The shunt regulator of this invention controls the maximum voltage so that it is within tolerable voltage limits and can be employed in operation of electro-mechanical or electronic devices. Since the solar cell array 18 has an internal resistance, an increase in the load current reduces the voltage difference between positive and negative buses 19 and 75. The regulator of this invention controls the load current on a portion of the solar cell array so that the internal resistance of the array holds down the output voltage, and the bus voltage is thus maintained at the desired value.

Although the device which has just been described appears to afford the greater advantages for implementing the invention, it will be understood that various modifications may be made thereto without going beyond the scope of the invention, it being possible to replace certain elements by other elements capable of fulfilling the same technical function therein.

What is claimed is:

1. Apparatus for regulating a source of current and significantly reducing power dissipation in said apparatus comprising:

a source of current comprising solar cells;

a plurality of power stages connected between said source of current and ground for shunting excess current; and a plurality of switching means connected to said power stages for activating said stages in sequence such that substantially when one power stage is saturated, the next stage is activated, until all of said power stages have been activated and then saturated in sequence;

said power stage comprises a plurality of power transistors with their bases connected together and their collectors connected to said current source and their emitters connected to ground;

said switching means comprise a plurality of different valued zener diodes for sequentially shunting excess current to ground.

2. The apparatus of claim 1 wherein said power stage comprises two NPN power transistors with their bases connected to each other, their collectors connected to said current source and their emitters connected to ground.

3. A regulator for maintaining a predetermined output voltage from a solar cell array by sequentially shunting excess current by means of power inputs, a series of switching means, driver means, and power stages comprising:

an error amplifier connected to the positive and negative buses of said solar cell array for detecting any deviation from a predetermined voltage level required from said solar array;

predriver means connected to the output of said error amplifier and to said driver means for causing each of said driver means to conduct;

first driver means connected between the output of said predriver and the input to the first of said power stages for activating said first power stage;

said first power stage controlled by the output of said first driver and connected between the first of said power inputs from said solar array and ground for shunting excess current from said solar array to ground;

the first of said switching means connected between the output of said predriver and the input to the second of said drivers for activating the second of said driver means when the said first power stage becomes saturated;

said second driver connected between the output of said first switching means and the input to the second of said power stages for activating said second power stage;

said second power stage controlled by the output of said second driver and connected between the second of said power inputs from said solar array and ground for shunting excess current from said solar array to ground;

the (n−1)th of said switching means connected between the output of said predriver and the input to the n th of said drivers for activating the *n* th of said drivers when the previous power stage becomes saturated;

said *n* th driver connected between the output of said (*n*−1)th switching means and the input to the *n* th of said power stages for activating said *n* th power stage;

said *n* th power stage controlled by the output of said *n* th driver and connected between the *n* th of said power inputs from said solar array and ground for shunting excess current from said solar array to ground; and said switching means being a plurality of different valued zener diodes for sequentially shunting excess current to ground.

4. The regulator of claim 3 wherein said error amplifier comprises an operational amplifier.

5. The regulator of claim 3 wherein said predriver comprises a NPN transistor.

6. The regulator of claim 3 wherein said driver means comprises a PNP transistor.

7. The regulator of claim 3 wherein said power stage comprises two NPN power transistors with their bases connected to said driver means and to each other, their collectors connected to said power input from said solar cell array and their emitters connected to ground.

* * * * *